US011384533B2

(12) United States Patent
Wilson

(10) Patent No.: US 11,384,533 B2
(45) **Date of Patent: *Jul. 12, 2022**

(54) CORNER STRUCTURE FOR STUDDED WALLS

(71) Applicant: Robert Brandon Wilson, Andover, KS (US)

(72) Inventor: Robert Brandon Wilson, Andover, KS (US)

( * ) Notice: Subject to any disclaimer, the term of this patent is extended or adjusted under 35 U.S.C. 154(b) by 1 day.

This patent is subject to a terminal disclaimer.

(21) Appl. No.: 16/935,466

(22) Filed: Jul. 22, 2020

(65) Prior Publication Data

US 2021/0025162 A1 Jan. 28, 2021

Related U.S. Application Data

(63) Continuation-in-part of application No. 16/521,735, filed on Jul. 25, 2019, now Pat. No. 10,822,795.

(51) Int. Cl.

| | |
|---|---|
| ***E04B 1/00*** | (2006.01) |
| ***E04B 2/72*** | (2006.01) |
| ***E04B 1/32*** | (2006.01) |

(52) U.S. Cl.

CPC ..... *E04B 2/721* (2013.01); *E04B 1/32* (2013.01); *E04B 2/723* (2013.01); *E04B 2002/725* (2013.01)

(58) Field of Classification Search

CPC ..... E04B 2/721; E04B 2001/405; E04B 1/08; E04B 2/767; E04B 2/768; E04G 17/004; A47G 1/1653; E04C 3/00

USPC ... 52/745.1, 745.09, 667, 653.1, 712, 481.1, 52/656.9, 656.1, 654.1, 481.2, 474, 476, 52/280, 281, 713, 715, 701, 704

See application file for complete search history.

(56) References Cited

U.S. PATENT DOCUMENTS

| | | | | |
|---|---|---|---|---|
| 1,350,633 A ‡ | 8/1920 | Allsworth | E04B 2/7854 | 52/354 |
| 2,124,519 A ‡ | 7/1938 | Piersen | E04B 1/08 | 52/272 |
| 3,964,216 A ‡ | 6/1976 | Hummel | E04B 1/34838 | 52/79.1 |
| 4,196,556 A ‡ | 4/1980 | Russo | E04B 1/2608 | 403/230 |
| 5,105,594 A ‡ | 4/1992 | Kirchner | A47G 5/00 | 160/135 |
| 5,226,755 A ‡ | 7/1993 | Tweedt | E04B 2/72 | 248/300 |

(Continued)

*Primary Examiner* — Chi Q Nguyen

(74) *Attorney, Agent, or Firm* — Hovey Williams LLP

(57) ABSTRACT

A building wall with an improved corner structure having a having a right-angled interior corner and an arcuate exterior corner, corner brackets used to construct the same, and a method of constructing the same. The pair of brackets include a first bracket that attaches to an upper end of both a first studded wall and a perpendicularly extending second studded wall, and a second bracket that attaches to a lower end of both the first studded wall and the second studded wall. When the first studded wall is joined to the second studded wall using the pair of brackets, an interior side of the corner joint includes two interior faces coming together at the right-angled corner, and an exterior side of the corner joint directly opposite the right-angled corner includes an arcuate exterior face.

20 Claims, 10 Drawing Sheets

(56) References Cited

U.S. PATENT DOCUMENTS 5,647,181 A * 7/1997 Hunts ..... A63H 33/10 312/111
5,706,624 A ‡ 1/1998 Lipson ..... E04B 1/3211 403/403
5,901,523 A ‡ 5/1999 Tasi ..... A47B 57/54 248/223.41
5,974,745 A * 11/1999 Barr ..... E06B 1/10 49/504
6,044,601 A ‡ 4/2000 Chmela ..... E04F 19/028 248/345.1
6,581,337 B1 * 6/2003 Skov ..... E04B 1/34315 52/79.5
9,279,249 B2 ‡ 3/2016 Surowiecki ..... E04B 2/789
9,534,371 B2 ‡ 1/2017 Judd ..... E04B 1/344
10,822,795 B1 * 11/2020 Wilson ..... E04B 2/7457
2009/0077914 A1 ‡ 3/2009 Ligabue ..... E04F 19/049 52/254
2009/0179137 A1 * 7/2009 Fournier ..... E04G 17/00 249/48
2009/0272051 A1 ‡ 11/2009 Sipe ..... E04B 1/08 52/210
2010/0043321 A1 * 2/2010 Mees ..... E06B 3/988 52/213
2011/0094174 A1 ‡ 4/2011 Meahl ..... E04F 19/04 52/288.1
2011/0120025 A1 * 5/2011 Matthews ..... E04F 13/06 52/62
2012/0306335 A1 ‡ 12/2012 Herreid, II ..... A47B 81/002 312/238
2013/0086860 A1 * 4/2013 Solomon ..... E04B 2/7453 52/243.1
2016/0053484 A1 ‡ 2/2016 Van Rijsingen ..... E04F 19/062 16/231
2018/0209115 A1 ‡ 7/2018 Henriquez ..... E04B 2/86
2018/0220799 A1 ‡ 8/2018 Mueller ..... F16M 11/38
2020/0149266 A1 ‡ 5/2020 Griechen ..... E04B 2/58

* cited by examiner
‡ imported from a related application

PROIR ART

PROIR ART

CORNER STRUCTURE FOR STUDDED WALLS

CROSS-REFERENCE TO RELATED APPLICATION

This application is a continuation-in-part of U.S. patent application Ser. No. 16/521,735, filed Jul. 25, 2019, now U.S. Pat. No. 10,822,795, which in incorporated by reference herein in its entirety.

TECHNICAL FIELD

The present invention relates to an improved structured used in the construction of a building wall and, more specifically, to a beveled or rounded corner structure used to construct a studded wall.

BACKGROUND OF THE INVENTION

Building walls are often made using upright studs. This technique is common for both residential and business uses. Studs are typically formed from wood or metal, although other materials may be used. Studs usually extend from a base or sill plate at the bottom of the erected wall to a top plate near the top of the erected wall. Studs may be anchored in various fashions, such as using screws, nails, or other fasteners, at both the top (i.e., to the top plate) and the bottom (i.e., to the sill plate). Most building techniques using studs space the vertically oriented studs at regular intervals, such as every sixteen inches or two feet as measured from the center of the stud. A stud will usually be provided at the terminal end of each row of studs even if the regular spacing of studs would not yet require one, as a terminal stud makes adjoining a row of studs to another row of studs easier and more reliable. A material such as drywall may then be fastened to the studs to provide a surface for the wall.

In such traditional studded construction, corners are typically formed as a right angle as measured from either side of the wall. Often, this is accomplished by abutting the end of one row of studs against the face of another row of studs. This technique is simple to implement, as no mitered cuts or special materials are required. However, this approach can lead to a sloppy and/or imperfectly square corner if one or both rows of studs are too long or too short.

While square corners are typical in construction, they are not the only corner construction technique. Often, square corners are not desirable. For example, when the point of a square corner protrudes into a high traffic area such as a hallway, the right angle of the corner can impede traffic flow. Further, the point of the corner can be damaged by people or equipment passing it. In these and other examples where a square corner is not desired, another corner shape such as a beveled or round corner may be constructed.

A beveled corner usually adds a very short stud row, perhaps with only one or two studs, that meets to other two stud rows in non-right corners. For example, a first stud row may meet a short stud row at a forty-five-degree interior angle, and the short stud row may then meet a second stud row at a forty-five-degree angle. The resulting corner may have a relatively long beveled face on the outside of the corner and a relatively short, parallel beveled face on the inside of the corner. A rounded corner may be formed by arranging a series of studs in an arcuate arrangement at the intersection of two adjoining walls, and then wrapping a flexible material such as thin sheathing or drywall about the inside and outside of the arcuately arranged studs, resulting in a corner that has a rounded, concave face on the inside of the corner and a rounded, convex face on the outside of the corner, with the outside rounded face having a greater radius of curvature than the inside face. Such construction techniques require highly skilled workers with training and tools to create the necessary connections. Further, any corner beveled or rounded in this manner inherently wastes materials, a fact that may be insignificant for a single corner but that can be significant for a large construction project involving tens or even hundreds of corners.

A further problem with traditional beveled or rounded corners is that while such configurations may be beneficial on the outside face of the resulting corner, the internal face of the beveled or rounded corner is usually impractical for the room on that side of the resulting wall. For example, furniture can often be fit into a room with square corners with relative ease, but the space within the interior of a beveled or rounded corner is apt to go to waste.

Thus, there remains a need for a building wall, and more particularly a corner assembly of a building wall, that overcomes one or more of the drawbacks of traditional construction, discussed above.

BRIEF SUMMARY OF THE INVENTION

The instant invention is generally directed to a corner structure for studded walls that overcomes the deficiencies of the traditional studded walls discussed above. The present invention does so by providing systems and methods for creating stud walls with a rounded or arcuate surface on the outer side of a corner joint and a squared corner on the inside of the corner joint. The rounded or arcuate surface presented on the outside of the corner joint is conducive for traffic flow, reduces the damage that may be expected to occur through wear and tear in comparison to a pointed square corner, and creates additional floor space where a square corner would otherwise have been formed. On the interior side of the corner joint, an efficient and usable square corner is presented.

More particularly, some embodiments of the instant invention are directed to a pair of brackets used to construct a corner joint joining a first studded wall to a second studded wall. The pair of brackets include a first bracket that attaches to an upper end of both the first studded wall and the second studded wall, and a second bracket that attaches to a lower end of both the first studded wall and the second studded wall. When the first studded wall is joined to the second studded wall using the pair of brackets, an interior side of the corner joint includes two interior faces coming together at a right-angled corner, and an exterior side of the corner joint directly opposite the right-angled corner includes a rounded or arcuate exterior face.

Other embodiments of the invention are directed to a building wall having a right-angled interior corner and an arcuate exterior corner. The building wall includes a first studded wall extending in a first direction and a second studded wall extending in a second direction perpendicular to the first direction. Each wall includes a horizontally extending top plate and sill plate and a plurality of vertically extending studs extending between the first top plate and the first sill plate. A pair of corner brackets as described above join the first studded wall to the second studded wall to form the right-angled interior corner and an arcuate exterior face.

Still other embodiments of the invention are directed to a method of constructing a building wall having a right-angled interior corner and an arcuate exterior corner. The method includes constructing a first studded wall extending in a first direction and constructing a second studded wall extending in a second direction perpendicular to the first direction. The method further includes joining the first studded wall to the second studded wall using a pair of corner brackets forming a corner joint such that an interior side of the corner joint includes two interior faces coming together at the right-angled interior corner and an exterior side of the corner joint directly opposite the right-angled interior corner includes an arcuate exterior face.

These and other features will be discussed in more detail in connection with the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

At a high level, the subject matter of this application generally relates to a building wall with an improved corner structure, corner brackets used to construct the same, and methods of constructing the same. This will be more readily understood with reference to the accompanying drawings.

Figure 1:
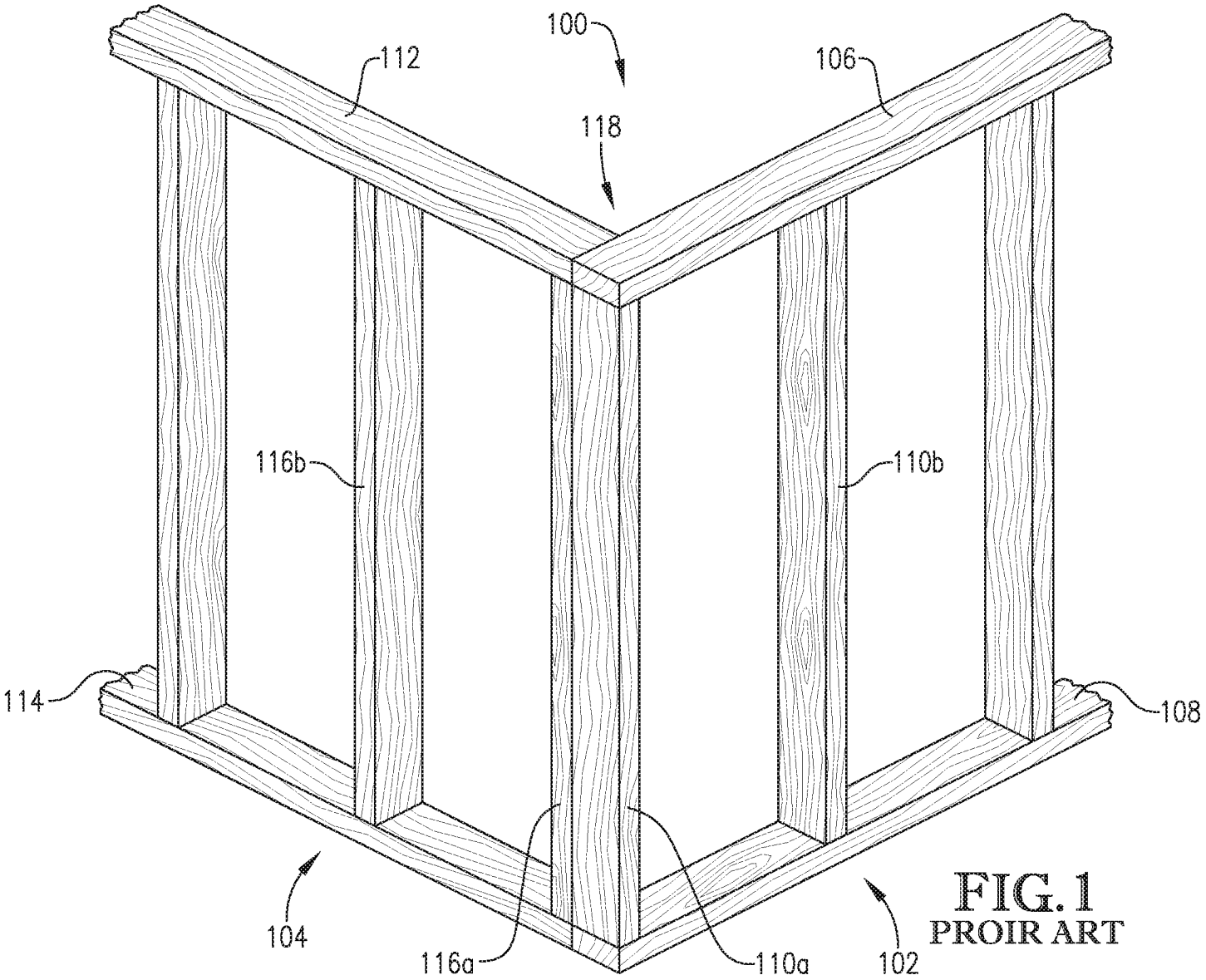
FIG. 1 is a front perspective view of a prior-art corner assembly used in traditional construction of building walls.
Figure 2:
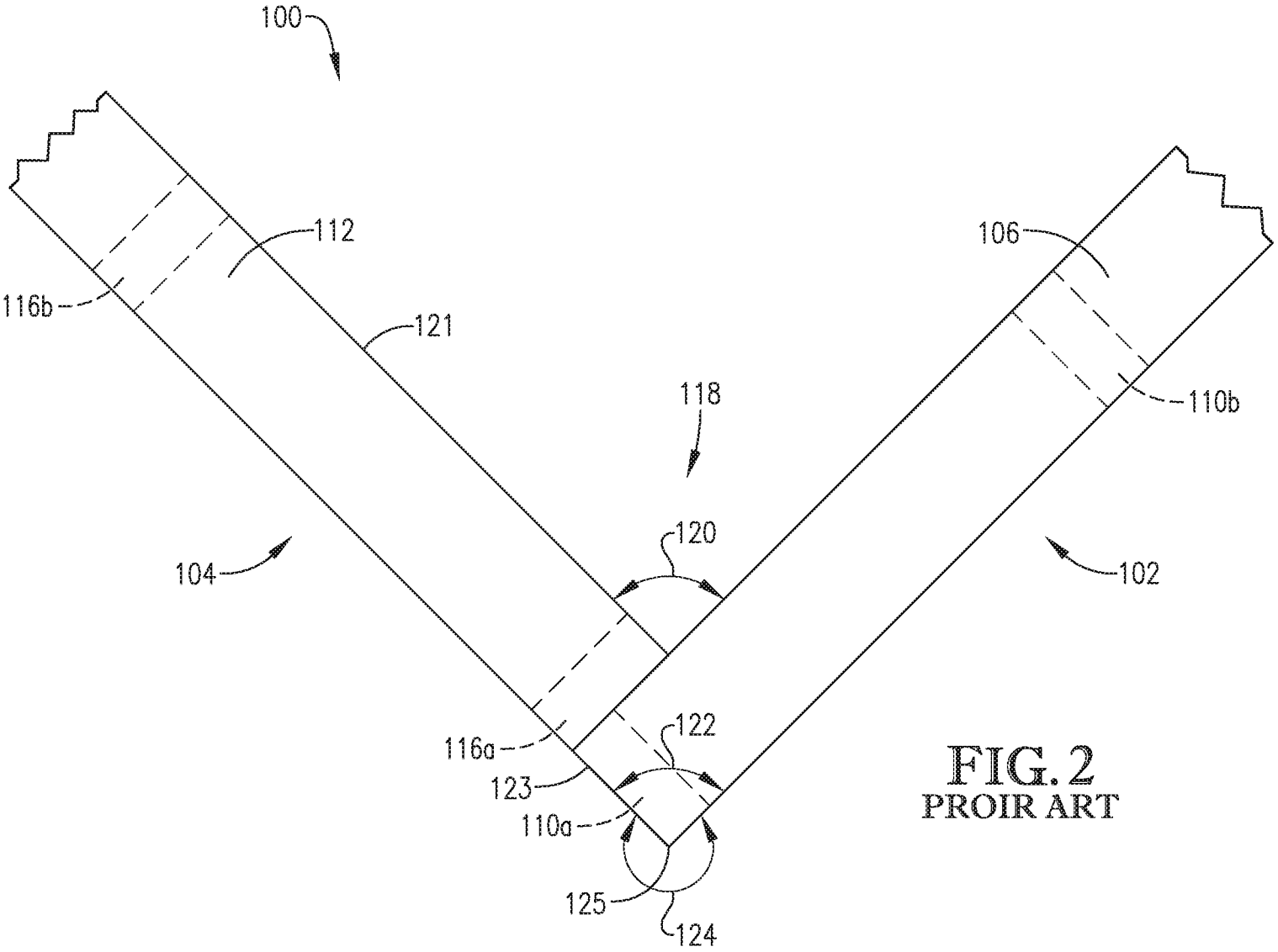
FIG. 2 is a top view of the corner assembly shown in FIG. 1.

FIGS. 1-2 show a prior-art corner assembly 100 traditionally employed when framing a corner joint 118 in a studded building wall. The corner assembly 100 includes a first wall 102 and a second wall 104 extending perpendicular to one another and meeting and abutting one another at the corner joint 118. The first wall 102 includes a horizontally extending top plate 106 and sill plate 108, with a plurality of vertically extending studs 110 extending therebetween. Similarly, the second wall 104 includes a horizontally extending top plate 112 and sill plate 114 with a plurality of vertically extending studs 116 extending therebetween. The top plates 106, 112, sill plates 108, 114, and studs 110, 116 may be constructed using any suitable construction materials such as, e.g., dimensional lumber (e.g., 2×4 or 2×6 studs), galvanized steel studs having similar dimensions as wood studs and corresponding galvanized steel track, or any other desired material.

As best seen in FIG. 2, the walls 102, 104 abut each other at the corner joint 118 forming a first right angle 120 on an interior wall 121 and forming a second, offset right angle 122 at the exterior wall 123. As used herein, "interior" refers to a space enclosed by two adjoining walls, and "exterior" refers to a space on the opposite side of the adjoining walls from the interior. Because this traditional corner joint 118 includes the two offset, right angles 120, 122, the corner assembly 100 results in an exterior wall 123 having a sharp corner protruding into the exterior space. Put another way, the exterior angle 124 formed by the abutting walls 102, 104 is 270 degrees. The exterior corner 125 formed by this corner joint 118 may impede traffic flow in the exterior space, can be easily damaged by people or equipment passing by it, and may be undesirable from an aesthetic standpoint.

Figure 11:
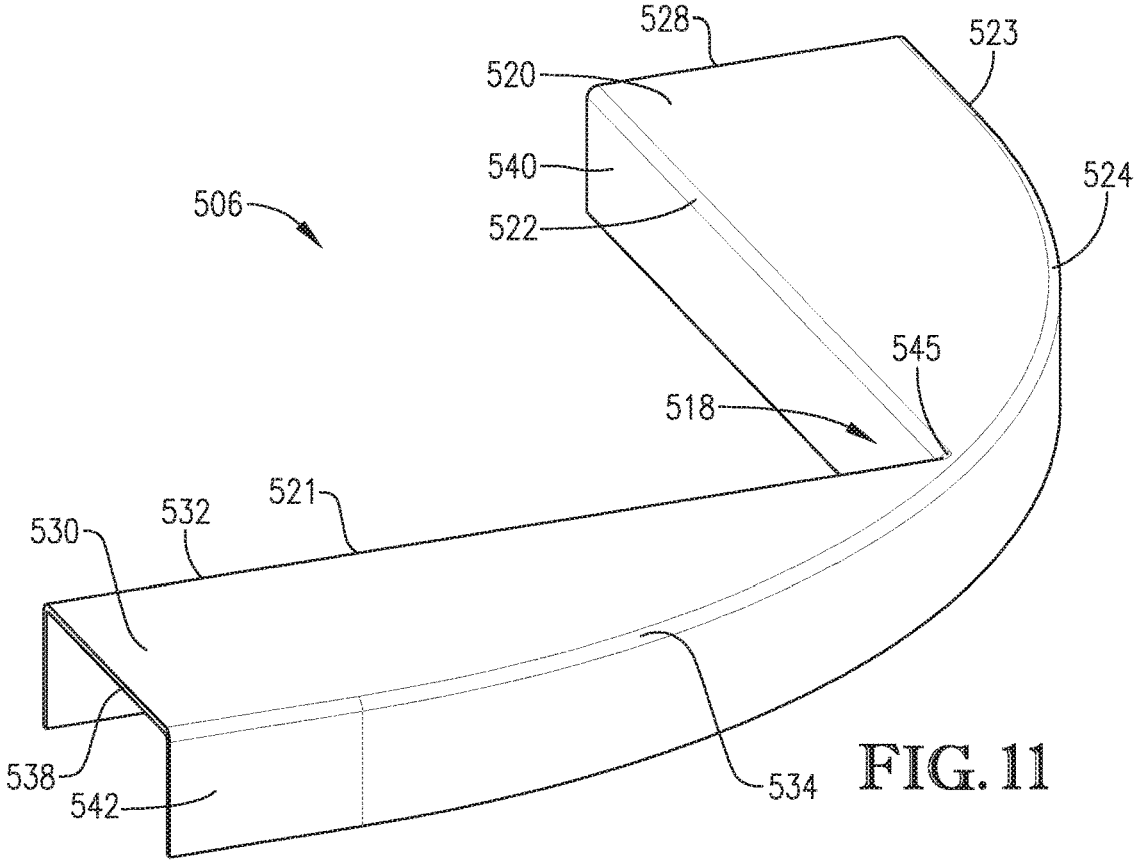
FIG. 11 is a top perspective view of a corner bracket used to create a rounded exterior corner according to an embodiment of the invention.
Figure 12:
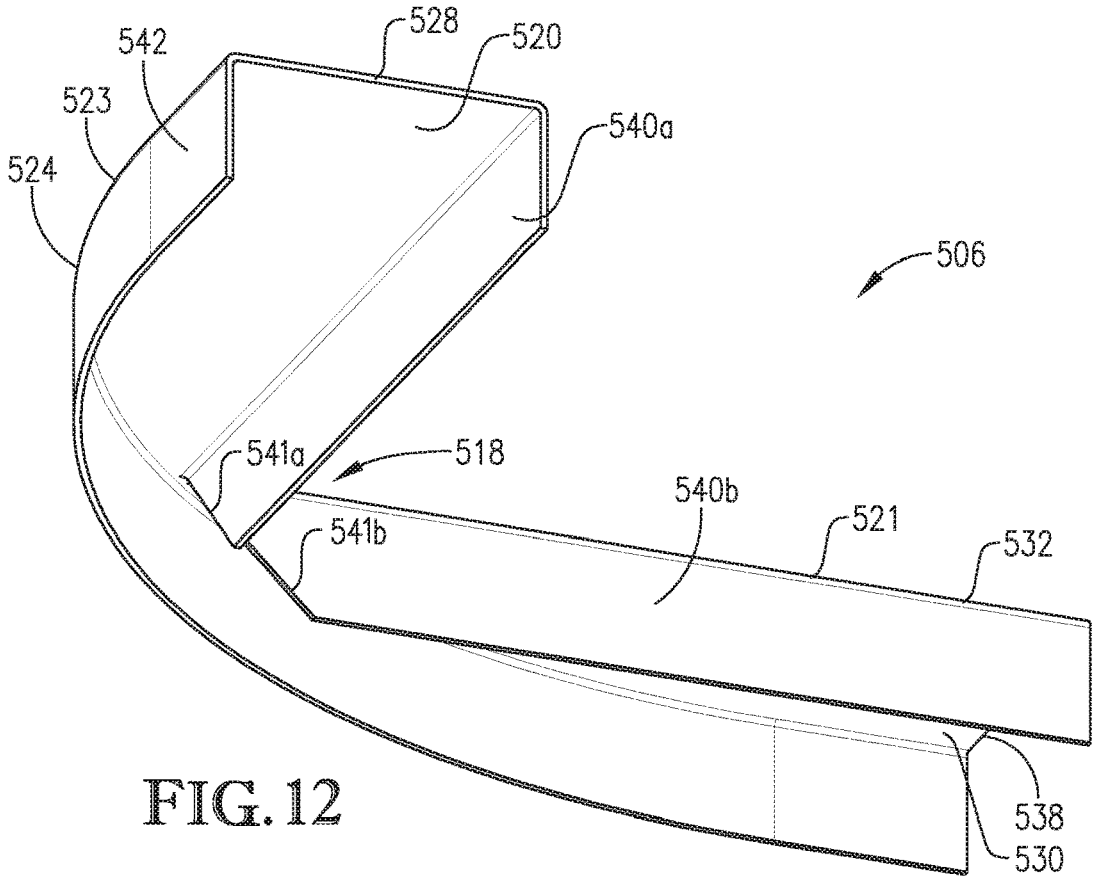
FIG. 12 is a bottom perspective view of the corner bracket shown in FIG. 11.

Some embodiments of the invention are directed to an improved corner assembly that eliminates the undesirable right angle at the exterior wall, but which maintains the right angle on the interior wall. This will be more readily understood with reference to FIGS. 3-12. More particularly, FIGS. 3-10 show a first embodiment of the invention in which a beveled exterior face is formed opposite a right-angle interior corner, while FIGS. 11-12 show a second embodiment of the invention in which a rounded or arcuate exterior face is formed opposite a right-angle interior corner.

Figure 3:
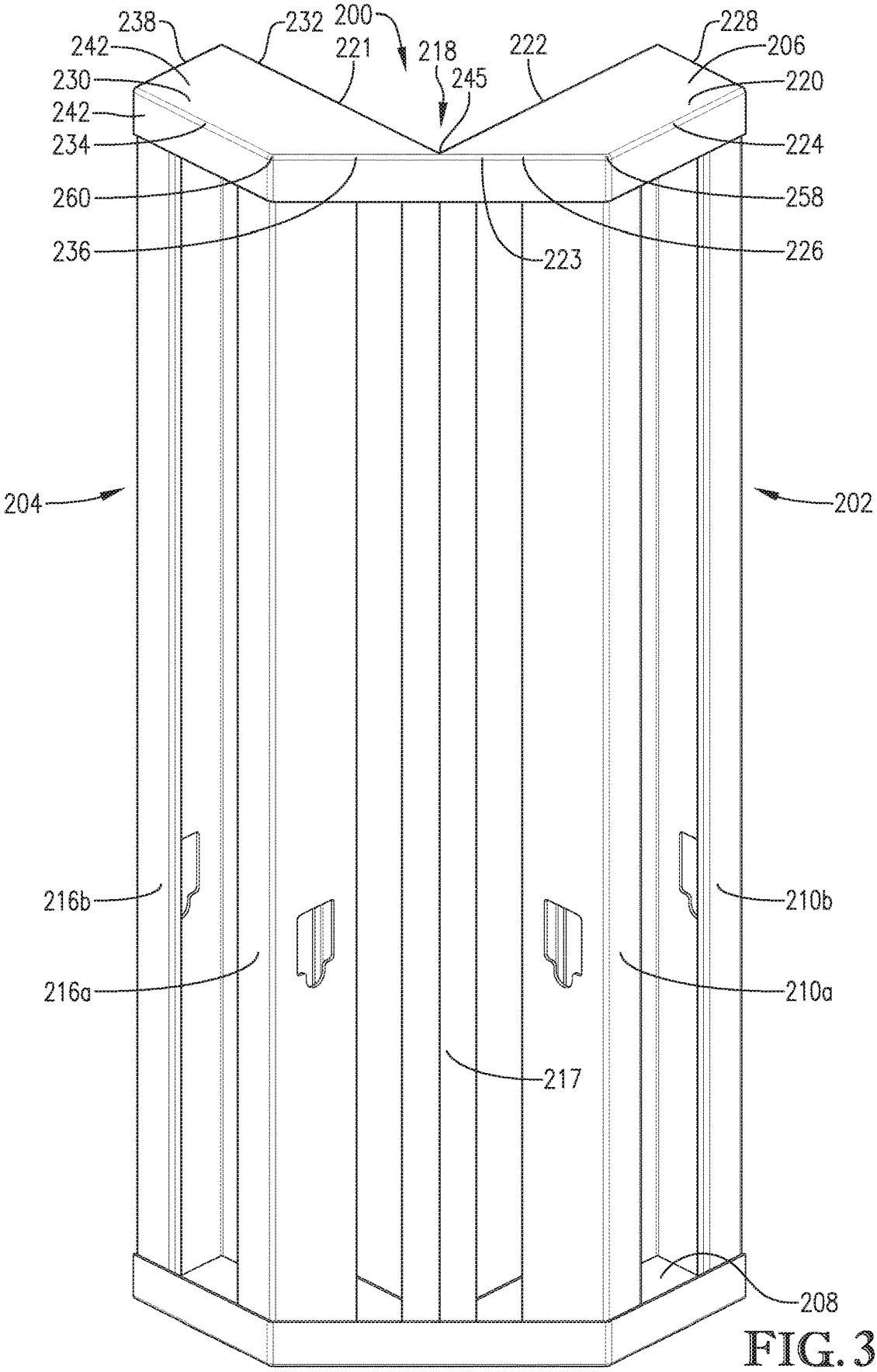
FIG. 3 is a front perspective view of a corner assembly according to one embodiment of the invention.
Figure 4:
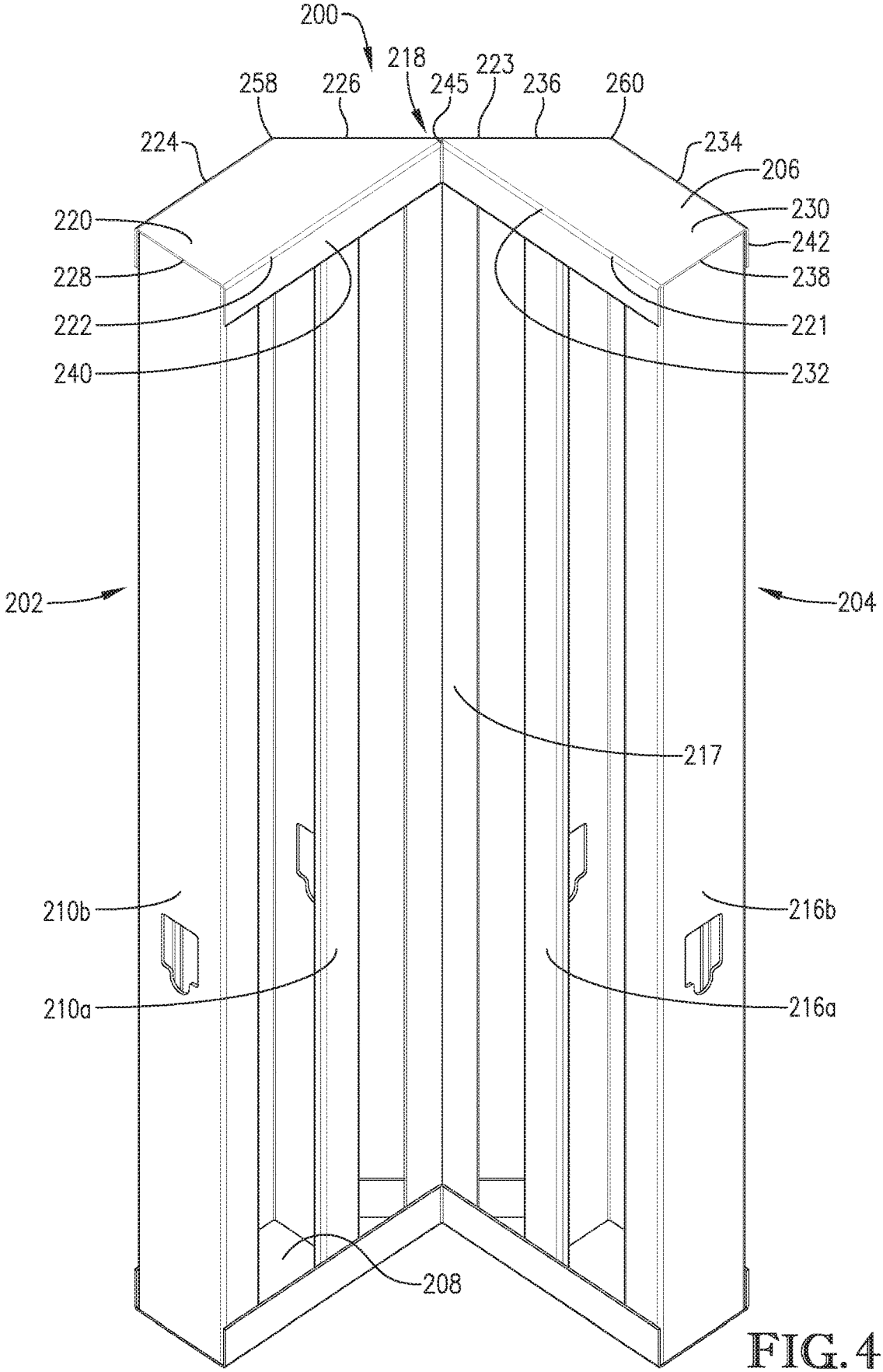
FIG. 4 is a rear perspective view of the corner assembly shown in FIG. 3.
Figure 5:
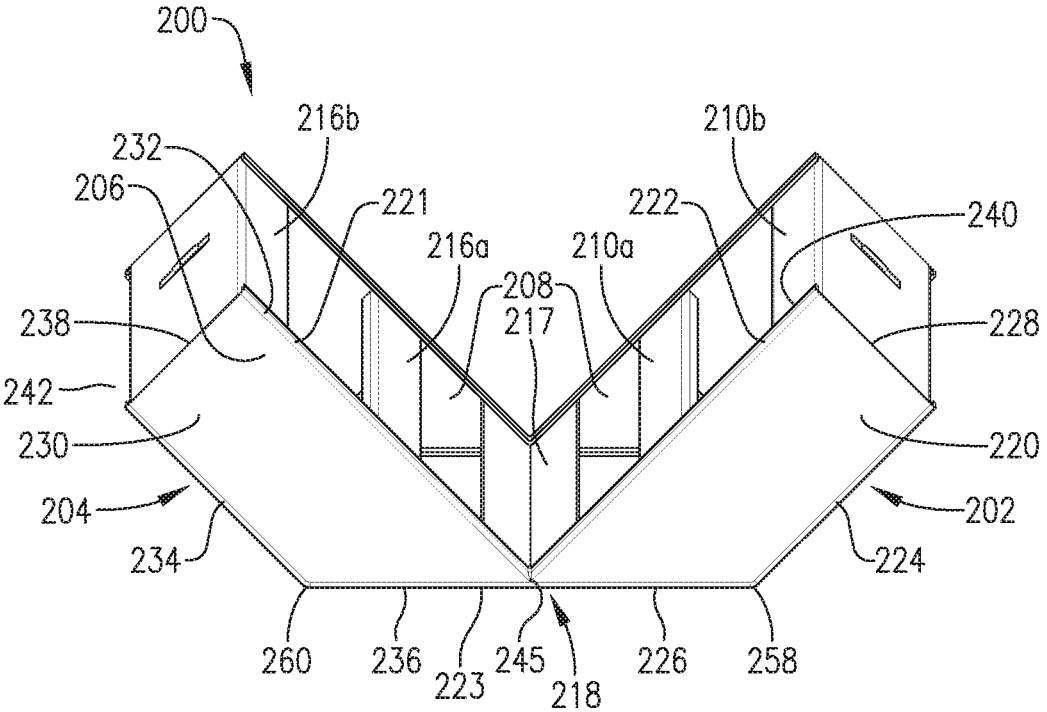
FIG. 5 is a top perspective view of the corner assembly shown in FIGS. 3-4.
Figure 7:
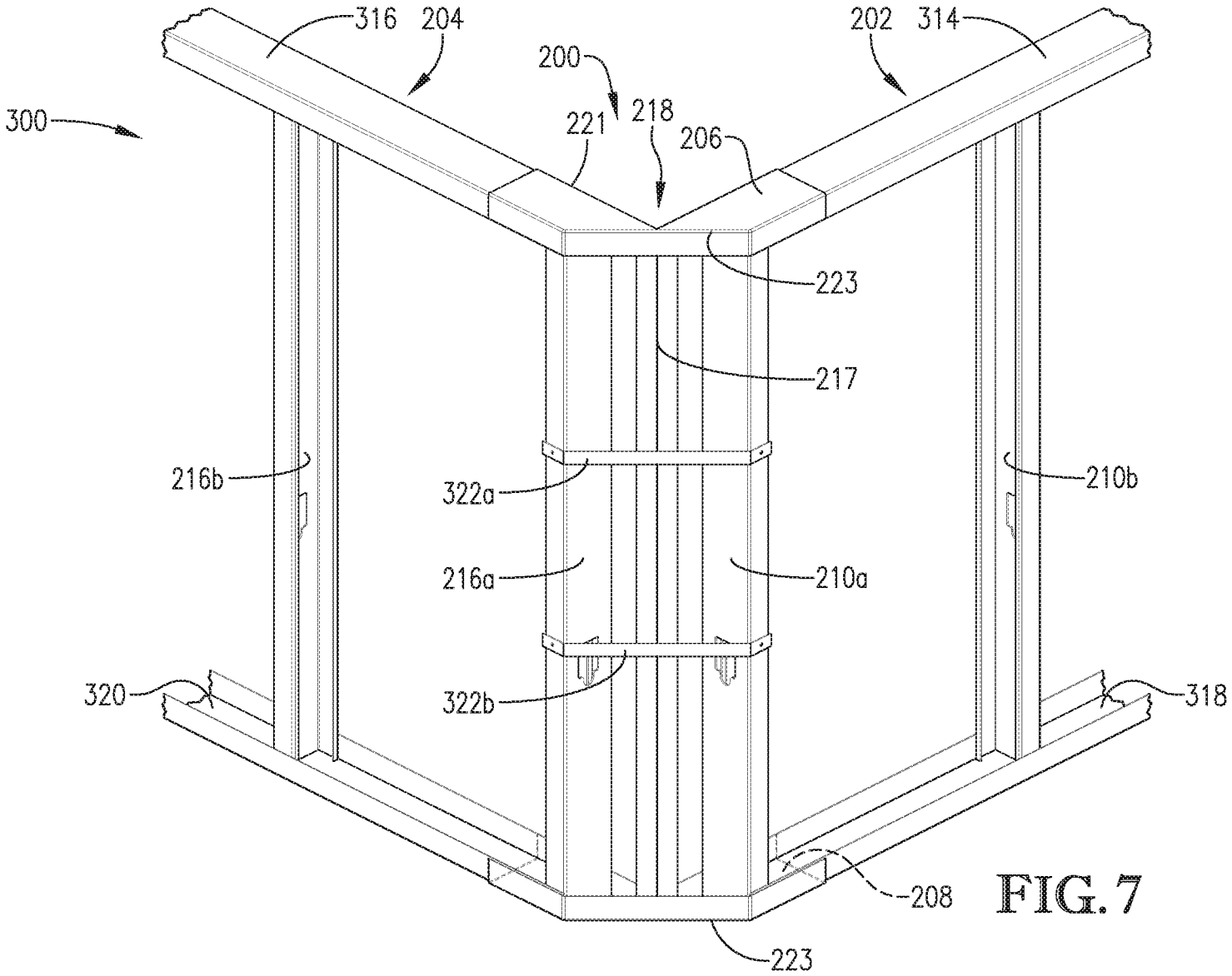
FIG. 7 is front perspective view of a studded building wall employing the corner assembly shown in FIGS. 3-6.

First, FIGS. 3-5 show a corner assembly 200 according to some aspects of the invention. The corner assembly 200 includes a portion of a first wall 202 extending in a first direction and a portion of a second wall 204 extending in a second direction perpendicular to the first direction. The first and second walls 202, 204 are joined together at corner joint 218. Like the walls 102 and 104 discussed above, the walls 202 and 204 include a plurality of spaced apart, vertically extending studs 210, 216, extending between top and sill plates. More particularly, the first wall 202 (more of which is shown in FIG. 7) includes a horizontally extending top plate 314 and sill plate 318, with a plurality of vertically extending studs 210 extending therebetween. Similarly, the second wall 204 includes a horizontally extending top plate 316 and sill plate 320 with a plurality of vertically extending studs 216 extending therebetween. Again, the top plates 314, 316, sill plates 318, 320, and studs 210, 216 may be constructed using any suitable construction materials such as, e.g., dimensional lumber (e.g., 2×4 or 2×6 studs) or galvanized steel studs and corresponding galvanized steel track. In other embodiments, different size dimensional lumber, steel studs, or other suitable building material may be utilized without departing from the scope of the invention. Moreover, the vertical height of walls 202, 204 (and thus corner assembly 200) will vary according the application, and thus the walls 202, 204 and corner assembly 200 can be of any vertical height without departing from the scope of this invention. For example, the walls 202, 204 and corner assembly 200 may be configured and sized such that a resulting finished space bounded by the walls 202, 204 has eight-foot, nine-foot, ten-foot, eleven-foot, twelve-foot, or even higher ceilings.

The corner assembly 200 includes a top bracket 206 and an opposing bottom bracket 208 that joins the perpendicularly extending first wall 202 and second wall 204 resulting in a corner joint 218 having a right-angled interior edge 221 and a beveled exterior edge 223 directly opposite to the right-angled interior edge 221, which will be discussed in more detail below. The brackets 206, 208 may be constructed using any suitable material and, in some embodiments, may be formed from metal and configured to be used with metal or wooden studs. In some examples, the brackets 206, 208 may be formed from a 20-gauge sheet of metal cut and folded to the desired size and shape. Preferably, the brackets 206, 208 are each formed from a single piece of sheet metal, which is stamped, folded, welded, or otherwise molded into the shape shown in the figures. In this regard, the corner assembly 200 is essentially a portion of a building wall bounded on top and bottom by a solid, integral top bracket 206 and bottom bracket 208, respectively, which result in a right-angled interior corner and beveled exterior face, as will become more apparent in light of the following discussion.

The top bracket 206 (best seen in FIGS. 9-10) includes a first track 220 and a second track 230. The tracks 220, 230 have a generally quadrilateral footprint (FIG. 6) and extend perpendicular to each other, corresponding to the direction of extension of the walls 202, 204. More particularly, the first track 220 is generally quadrilateral in plan view with the outer bounds formed by a first interior edge 222, a first exterior edge 224, a second exterior edge 226, and a first end 228. The second track 230, similarly, is generally quadrilateral in plan view with the outer bounds formed by a second interior edge 232, a third exterior edge 234, a fourth exterior edge 236, and a second end 238. The first and second interior edges 222, 232 together define an interior, right-angled interior edge 221, while the first, second, third, and fourth exterior edges 224, 226, 234, 236 together define a beveled exterior edge 223.

Extending downward—i.e., towards the bottom bracket 208—from the right-angled interior edge 221 and perpendicular thereto is a first lip 240, and extending downward from the beveled exterior edge 223 and perpendicular thereto is a second lip 242. The first and second lips 240, 242 are configured to surround at attach to the terminal ends of the studs 210, 216 disposed between the brackets 206, 208 and/or to portions of the corresponding top plates 314, 316 and sill plates 318, 320 (FIG. 7) disposed between the brackets 206, 208. The bottom bracket 208 opposes the top bracket 206 on a bottom side of the walls 202, 204, and is a mirror image of the first bracket 206 (i.e., the bracket 208 is configured with the lips thereof extending upward rather than downward). Thus, the individual components of bracket 208 will not be discussed in detail.

As best seen in FIGS. 3 and 4, when constructing the corner assembly 200 the brackets 206, 208 are arranged such the lips of each extend towards one another with the studs 210, 216 extending therebetween and fastened in place. More particularly, in the embodiment shown, the corner assembly includes two studs 210*a*, 210*b* provided beneath the first track 220, and two studs 216*a*, 216*b* provided beneath the second track 230. In other embodiments, the corner assembly 200 may include more or less studs 210, 216 below each track 220, 230 without departing from the scope of the invention. With respect to the first wall 202, a terminal stud 210*a* is provided proximate one end of first exterior edge 224, while a second stud 210*b* is provided proximate an opposite end of the first exterior edge 224. Similarly, for the second wall 204, a terminal stud 216*a* is provided proximate one end of third exterior edge 234, while a second stud 216*b* is provided proximate an opposite end of the third exterior edge 234. The first lip 240 of the top bracket 206 is in turn fastened (i.e., screwed, bolted, nailed, glued, etc.) to the upper ends of the studs 210, 216 on an interior side thereof, while the second lip 240 of the top bracket 206 is fastened to the upper ends of the studs 210, 216 on an exterior side thereof. Lower ends of the studs 210, 216 are similarly fastened to lips of the bottom bracket 208. Moreover, in some embodiments the studs 210, 216 forming the corner assembly 200 may extend between a top plate, such as plates 314 and 316 in FIG. 7, and a sill plate, such as plates 318 and 320 in FIG. 7. In such embodiments, the lips 240, 242 of the brackets 206, 208 would thus surround and fasten to the top plates 314, 316 and sill plates 318, 320, respectively, rather than or in addition to the studs 210, 216 themselves. In some embodiments, a corner support 217 may also extend between the two brackets 206, 208. The corner support 217 is a ninety-degree channel extending between (and affixed to) a location on the top bracket 206 near the corner 245, and a similar location on the bottom bracket 208, which provides additional rigidity to the corner assembly 200 and provides a surface for fastening drywall or the like.

In the depicted examples the studs 210 have the same thickness as the studs 216. As used herein, "thickness" refers to a dimension extending from the interior side to the exterior side of the described feature, as depicted by the dimension labeled "t" in FIG. 6. Because the studs 210 and studs 216 have the same thickness, a thickness of the first track 220 (i.e., a dimension corresponding to the first end 228) is the same size as a thickness of the second track 230 (i.e., a dimension corresponding to the second end 238). However, in other embodiments the first track 220 and the second track 230 may be sized to receive studs of different thicknesses, thereby advantageously allowing different thicknesses of walls to be joined using the brackets 206, 208. In many examples, however, both the plurality of first studs 210 and the plurality of second studs 216 may be made either of 2×4 dimensional lumber or metal studs of an equivalent size. As should be appreciated, while the "2×4" descriptor is based upon the unfinished dimension of a board two inches think and four inches wide, after planing such lumber has a smaller dimension; namely, 3.5 inches. Accordingly, both the first track 220 and the second track 230 may have a thickness of approximately 3.5 inches or slightly larger when configured to receive 2×4 studs, although other dimensions can be implemented to receive different dimensions of stud rows without departing from the scope of this invention. Moreover, the brackets 206, 208 may provide enough linear length of both the first track 220 and the second track 230 to securely receive and retain a stud row, such as that comprising the first wall 202 and the second wall 204. For example, the first exterior edge 224 and the third exterior edge 234 may be approximately 4 inches.

Figure 6:
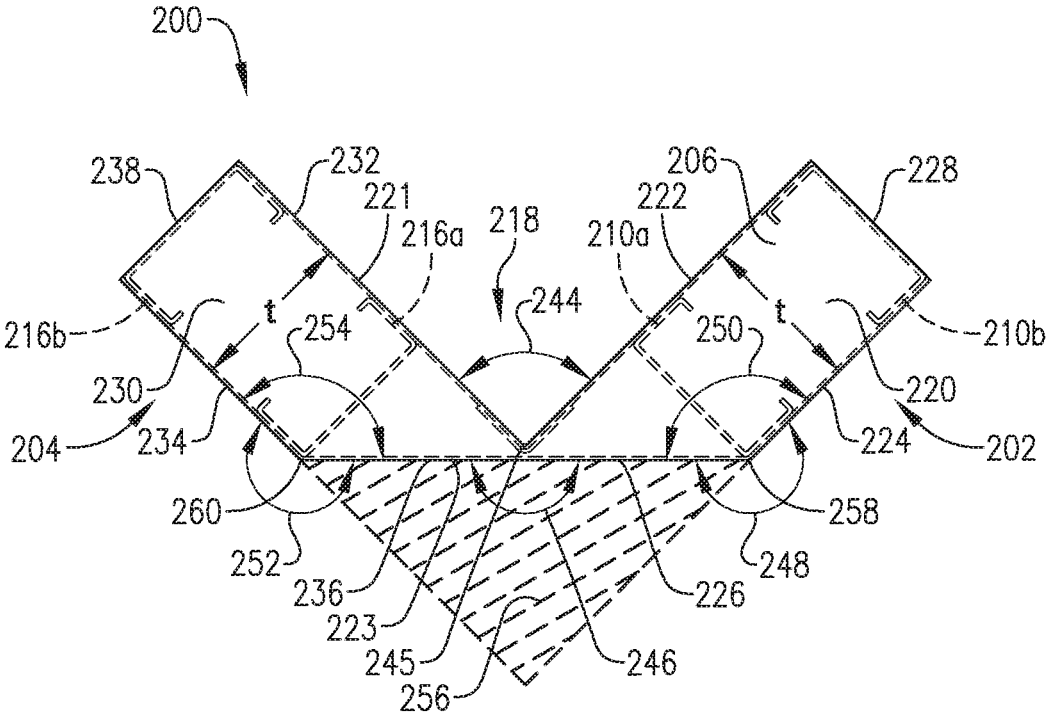
FIG. 6 is a top view of the corner assembly shown in FIGS. 3-5 and further schematically showing a reduced footprint achieved according to aspects of the invention.

Some of the benefits of the corner joint 218 formed by using brackets 206, 208 may be more readily understood with reference to FIG. 6, which shows the footprint of the corner assembly 200 formed using the brackets 206, 208. The resulting corner joint 218 includes an interior edge 221 that forms a right angle 244 at corner 245, similar to how the interior wall 121 of the prior art corner joint 118 forms the right angle 120. However, unlike the prior art corner joint 118, the corner joint 218 does not include an offset, right angle on the exterior wall. Instead, corner joint 218 forms a beveled exterior edge 223 defined by the first, second, third, and fourth exterior edges 224, 226, 234, 236. Thus, the resulting face of a wall formed by attaching drywall or the like to the exterior beveled edge 223 directly opposite the interior right angle 244 (i.e., beveled face 404 in FIG. 8) does not include an offset right angle—or, put another way, the beveled face forms a 180-degree external angle 246, as compared to the 270-degree external angle 124 formed by the prior art corner joint 118. The beveled corners 258, 260, in turn, each form a 225-degree external angle 248, 252, respectively (or, when viewed from the interior side, 135-degree angles 250, 254, respectively).

This beveled exterior edge 223 and resulting 225-degree angle portions 248, 252 at corners 258, 260 provides for a less severely angled exterior corner as compared to the 270-degree angle portion 124 formed by the prior art corner assembly 100, which in turn improves traffic flow among the other benefits discussed above. Moreover, in comparison to the footprint formed by the prior art corner assembly 100 shown in FIG. 2, the corner assembly 200 does not extend as far into the exterior space taking up less square footage that the prior art corner assembly 100. This is schematically illustrated by the cross-hatched reduced footprint 256 shown in FIG. 6. As should be appreciated, for walls having a thickness t as shown in FIG. 6, the area of the reduced footprint 256 is equal to $2*t^2$. Thus, when the corner assembly 200 is employed on each exterior corner within a building, the usable square footage of the building can be greatly increased—i.e., by $2*t^2$ for each corner assembly 200 used.

Figure 8:
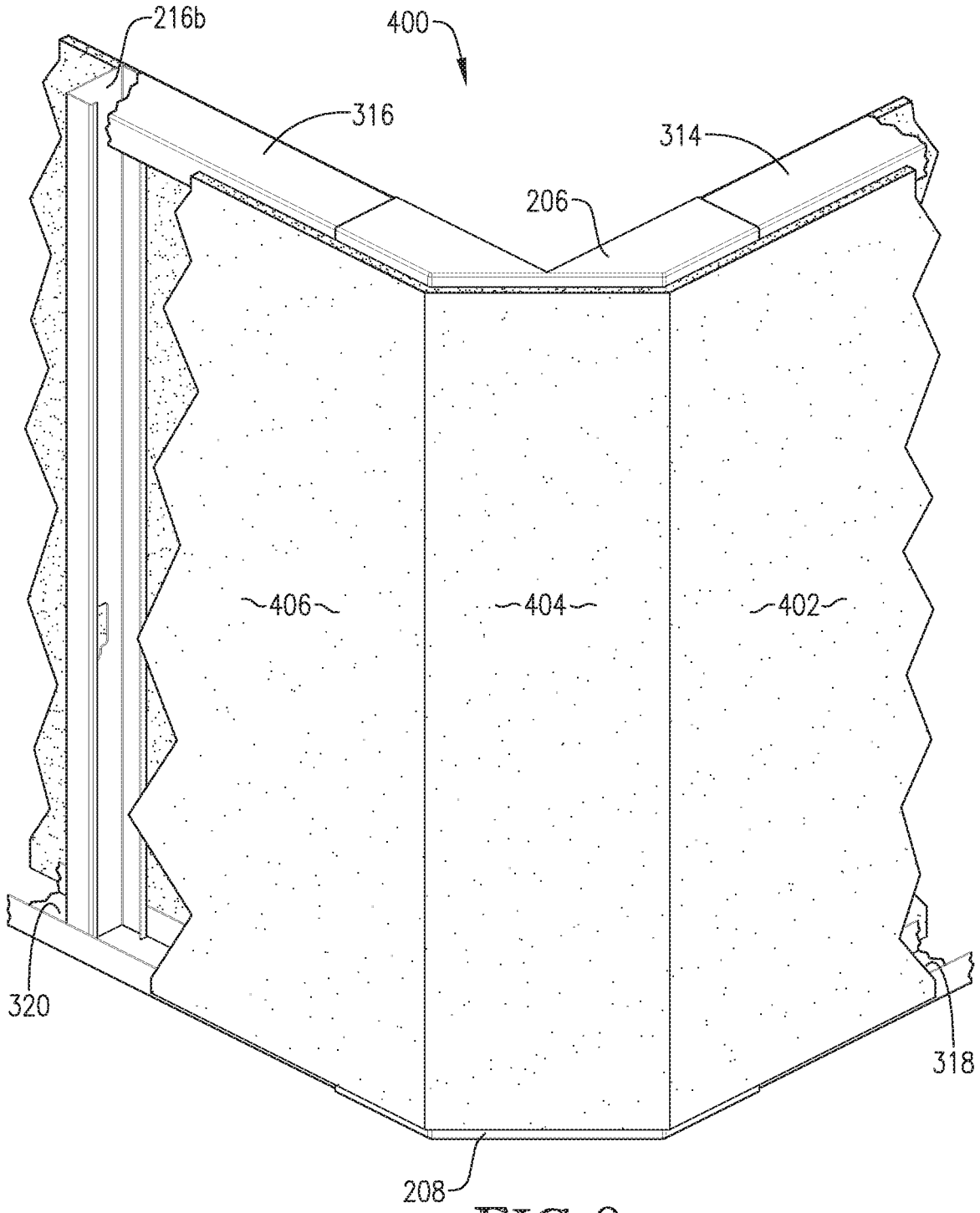
FIG. 8 is a front perspective view of a finished building wall employing the corner assembly shown in FIGS. 3-7.
Figure 9:
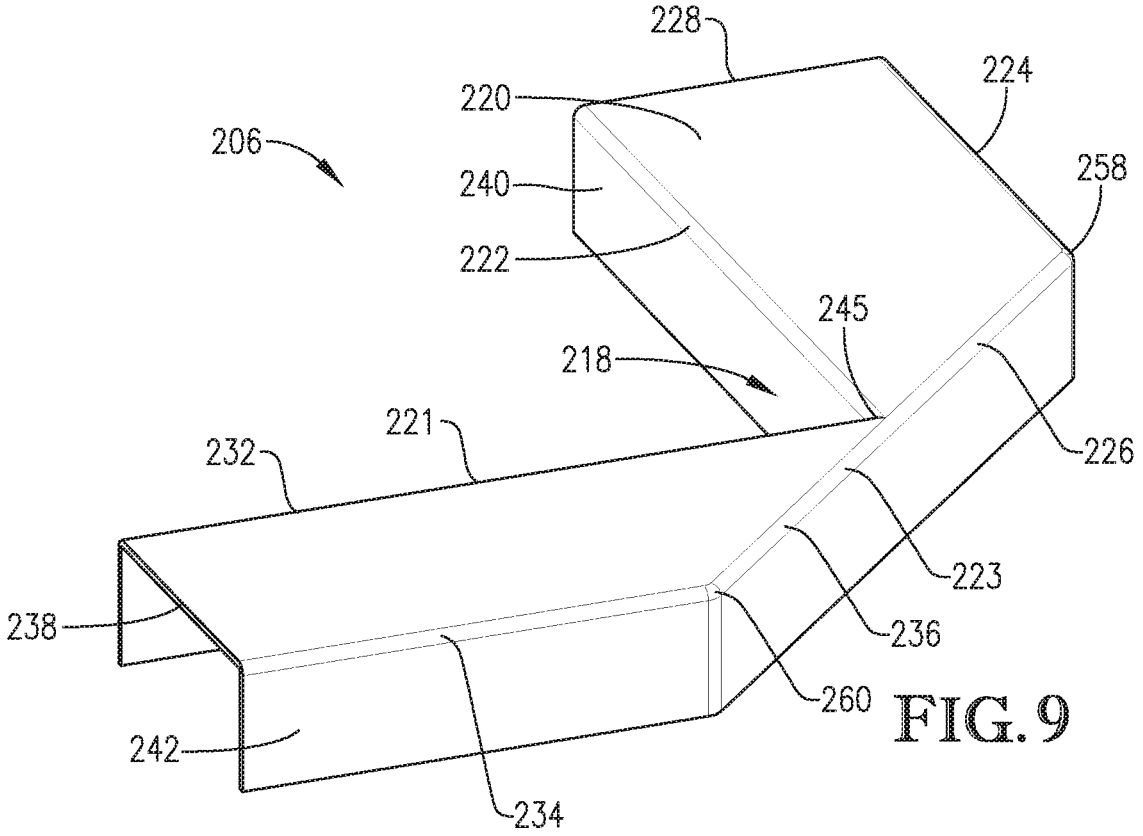
FIG. 9 is a top perspective view of a corner bracket used to create the structures shown in FIGS. 3-8.
Figure 10:
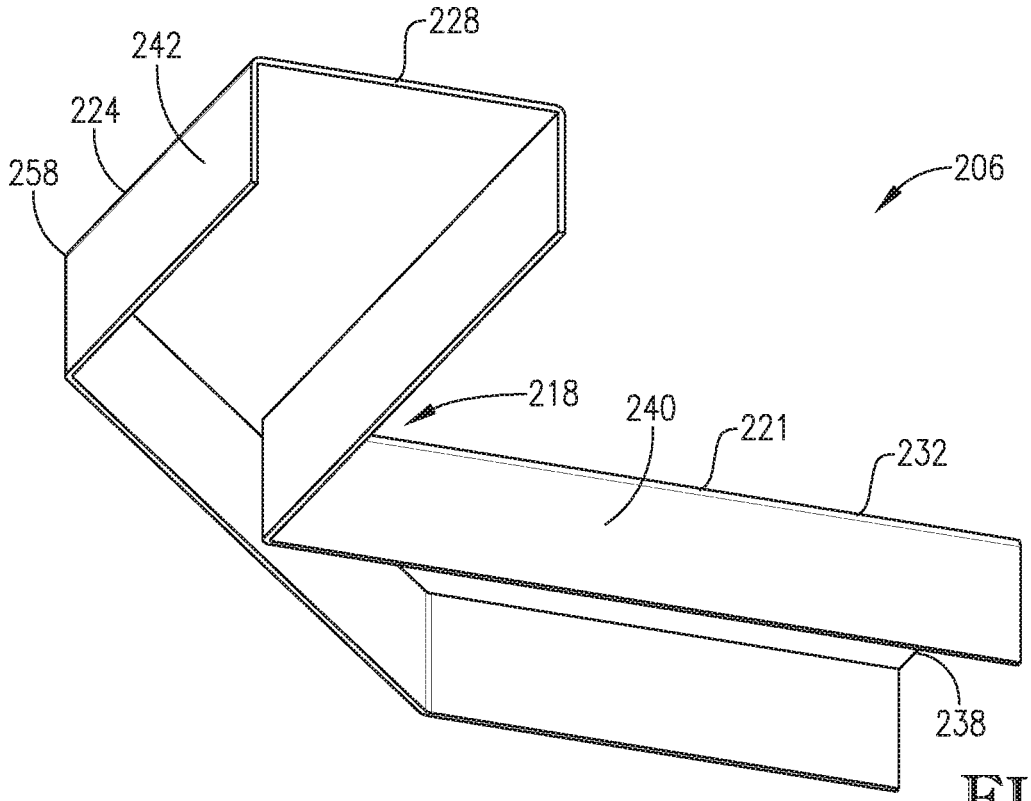
FIG. 10 is a bottom perspective view of the corner bracket shown in FIG. 9.

FIGS. 7 and 8 show an unfinished wall 300 and a finished wall 400, respectively, implementing the improved corner assembly 200 described in detail above. First, the unfished wall 300 generally includes a first wall 202 including a plurality of vertically extending studs 210 extending between a top plate 314 and a sill plate 318, and a second wall 204 including a plurality of vertically extending studs 216 extending between a top plate 316 and a sill plate 320. The walls 202, 204 extend perpendicular to each other are joined using the top bracket 206 and bottom bracket 208, forming the corner assembly 200 described above. More particularly, the lips 240, 242 of the top bracket 206 surround a portion of the top plates 314, 316 and are fastened thereto and/or to the upper portions of the terminal studs 210*a*, 216*a*, while the lips 240, 242 of the bottom bracket 206 surround a portion of the sill plates 318, 320 and are fastened thereto and/or to the lower portions of the terminal studs 210*a*, 216*a*. In this embodiment, only one stud 210, 216 of each wall 202, 204 is provided below each track 220, 230 of the top bracket 206, but, again, in other embodiments more studs 210, 216 can be implemented in the corner assembly 200 without departing from the scope of this invention. In this regard, when constructing the wall 300 according to aspects of the invention, a builder can simply frame two approaching, perpendicular studded walls 202, 204 that stop short of abutting one another, and in turn join them (or close the gap) using a kit of the two corner brackets 206, 208, forming the corner joint 218 described in detail above.

In some embodiments, the wall 300 may include the corner support 217 and/or horizontal strapping or the like, shown in FIG. 7 as a plurality of horizontally extending exterior face supports 322. Each exterior face support 322 extends parallel to the exterior beveled edge 223 of the corner joint 218 from a terminal stud 210*a* (i.e., a stud 210*a* closest to the corner joint 218) in the first wall 202 to a terminal stud 216*a* in the second wall 204. In such embodiments, the corner support 217 and/or the plurality of horizontally extending exterior face supports 322 provide attachment points for, e.g., drywall, plywood, wood planks or paneling, or other desired sheathing or wall covering. While such horizontally extending exterior face supports 322 may be expected to be the most convenient to install and use, in some examples vertical strapping or supports extending between the brackets 206, 208 may be used in addition to or instead of the horizontally extending exterior face supports 322. Although in FIG. 7 only two horizontally extended face supports 322 are shown for illustrative purposes, any desired number of horizontally extended face supports 322 or other strapping (e.g., vertical supports) can be utilized in order to provide adequate surfaces for attaching the desired sheathing without departing from the scope of this invention. For example, in some embodiments, a support 322 may be installed every two feet such that the supports 322 are spaced twenty-four inches apart, center-to-center, in the vertical direction. In other embodiments, the supports may be installed closer or farther apart, if desired. For example, a support 322 may be installed every sixteen inches or one foot such that the supports 322 are spaced sixteen or twelve inches, respectively, apart, center-to-center, in the vertical direction.

FIG. 8 shows a finished wall 400 formed by fastening drywall or other suitable material to the wall 300. In this embodiment, the finished wall 400 includes three exterior faces 402, 404, 406. Each face is composed of drywall or the like attached to the vertically extending studs 210, 216 and, if equipped, the horizontally extending face supports 322 of the wall 300 shown in FIG. 7. Unlike traditional prior art walls, the finished wall 400 includes a beveled exterior face 404 that provides for increased usable square footage at the external corner. As should be appreciated, the interior wall directly opposite the beveled exterior face 404 will still include a right-angled corner, which is useful for, e.g., furniture placement, wall hangings, etc., within the interior space.

Figure 13:
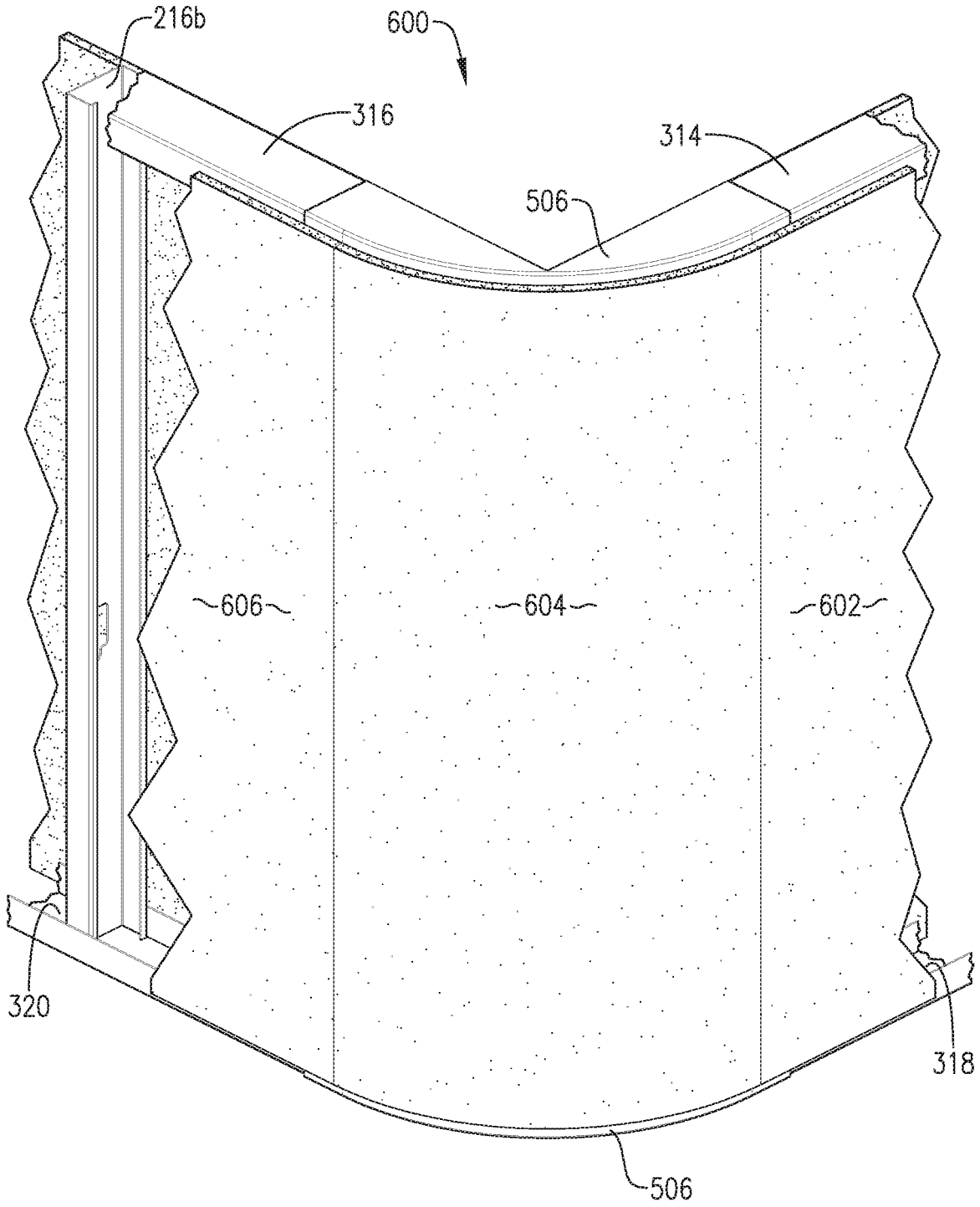
FIG. 13 is a front perspective view of a finished building wall employing the brackets shown in FIGS. 11-12.

Turning now to FIGS. 11-13, another embodiment of a bracket 506 used to form a corner assembly according to aspects of the invention is shown. An opposing pair of the brackets 506 is used form an improved corner joint by joining perpendicular extending walls in a similar manner as the brackets 206, 208 discussed above, but result in a wall having a rounded or arcuate external face rather than a beveled external face. Only a single bracket 506 will be described for ease of discussion, but it should be appreciated that, in a similar vein to the brackets 206, 208, when used to form a corner assembly two brackets 506 will be paired together with the lips 540, 542 of each facing each other and with perpendicularly extending walls extending therebetween (FIG. 13). As with brackets 206, 208, the bracket 506 may be constructed using any suitable material and, in some embodiments, may be formed from metal and configured to be used with metal or wooden studs. In some examples, the bracket 506 may be formed from a 20-gauge sheet of metal cut, folded, and/or welded to the desired size and shape. For example, the bracket 506 may be formed from a single piece of sheet metal, which is stamped, folded, welded, or otherwise molded into the shape shown in FIGS. 11-12. Or else the bracket 506 may be formed from several pieces of sheet metal cut to a desired shape and then welded together to form the assembly shown in FIGS. 11-12.

The bracket 506 includes a first track 520 and a second track 530. The tracks 520, 530 extend perpendicular to each other, corresponding to the direction of extension of the walls meeting to form a corner assembly. The first track 520 is generally fin-shaped in plan view. In the context of this disclosure, "fin-shaped" is used to mean an area that is bounded by two, unequal length straight edges coming together at a right angle and a third arcuate edge substantially (but not completely) joining the free distal ends of the two straight edges. The fin-shaped first track 520 is bounded by a first interior edge 522, a first exterior edge 524, and a first end 528. The second track 530, similarly, is generally fin-shaped in plan view with the outer bounds formed by a second interior edge 532, a second exterior edge 534, and a second end 538. The first and second interior edges 522, 532 together define an interior, right-angled interior edge 521, while the first and second exterior edges 524, 534 together define a rounded or arcuate exterior edge 523.

Extending downward from the right-angled interior edge 521 is a first lip 540 and extending downward from the rounded or arcuate exterior edge 523 is a second lip 542. The first and second lips 540, 542 are configured to surround at attach to the terminal ends of studs disposed between a pair of the brackets 506 and/or to portions of the corresponding top plates and sill plates disposed between the pair of brackets 506 in a similar manner as the lips 240, 242, of the beveled corner brackets 206, 208 discussed above, and thus the general construction of the two walls joined using the brackets 506 will not be discussed again in detail. In such a configuration, a first bracket 506 used at the top of the corner assembly opposes a second bracket 506 used at the bottom of the corner assembly with the lips of each extending towards the other bracket 506 as discussed above. The lips 540, 542 may be continuous or noncontinuous along their respective length. For example, in the depicted embodiment the second lip 542 is continuous along its length while the first lip 540 is comprised of two, noncontinuous sections 540*a*, 540*b*, with a first section 540*a* extending from the first interior edge 522 and a second section 540*b* extending from the second interior edge 532. In the depicted embodiment, each section 540*a*, 540*b* of the lip 540 extends substantially the entire length of the respective edges 522, 532 and includes an angled end 541*a*, 541*b* proximate the right-angled corner 518 formed by the bracket 506. Such embodiments may ease manufacturing, as the lip 540 can be formed by cutting a piece of sheet metal or the like to form the angled ends 541*a*, 541*b* at the cut, and then folding the sections 540*a*, 540*b* ninety-degrees downward from the tracks 520, 530 to form the lip 540.

In the depicted embodiment, a thickness of the first track 520 (i.e., a dimension corresponding to the first end 528) is the same size as a thickness of the second track 530 (i.e., a dimension corresponding to the second end 538). However, in other embodiments the first track 520 and the second track 530 may be sized to receive studs of different thicknesses, thereby advantageously allowing different thicknesses of walls to be joined using the brackets 506, 508. In many examples, however, the studs received within the first track 520 will have the same thickness as the studs received within the second track 530, which may be, e.g., 2×4 dimensional lumber or metal studs of an equivalent size. Both the first track 520 and the second track 530 may have a thickness of approximately 3.5 inches or slightly larger when configured to receive 2×4 studs, although other dimensions can be implemented to receive different dimensions of stud rows without departing from the scope of this invention. Moreover, the bracket 506 may provide enough linear length of both the first track 520 and the second track 530 to securely receive and retain a stud row. In some embodiments, the first exterior edge 524 and the second exterior edge 534 may have a portion thereof that extends parallel to the first interior edge 522 and second interior edge 532, respectively, along a sufficient distance (e.g., four inches or more) in order to secure multiple studs within each track 520, 530. In such embodiments, the exterior edge 523 will thus be curved along a majority, but not entirety, of its length.

As with the brackets 206, 208, the resulting corner joint 518 formed by the brackets 506 exhibits a reduced footprint, provides improved traffic flow, and has an improved finished appearance as compared to the traditional corner structure shown in FIGS. 1-2. More particularly, FIG. 13 shows a finished wall 600 implementing the brackets 506 to form an improved corner structure at the intersection of two studded walls. Similar to the finished wall 400 discussed in connection with FIG. 8, the finished wall 600 includes two studded walls approaching one another at a right angle, the construction of which will not be discussed again in detail. However, when a pair of brackets 506 are used to form the wall 600, the resulting finished face includes a rounded or arcuate corner formed by the rounded or arcuate exterior edge 523 of the brackets 506. More particularly, the finished wall 600 includes three exterior faces 602, 604, 606. Each face is composed of sheathing such as drywall or the like attached to the vertically extending studs 210, 216 and/or horizontally extending face supports. In this embodiment, the horizontal extending supports, when equipped, would be preformed in an arcuate configuration having the same radius of curvature as the arcuate extending edges 523 of the brackets 506. Unlike traditional walls, the finished wall 600 includes a rounded or arcuate exterior face 604 that provides for increased usable square footage at the external corner, improved traffic flow, and increased aesthetics. As should be appreciated, the interior wall directly opposite the rounded or arcuate exterior face 604 will still include a right-angled corner, which is useful for, e.g., furniture placement, wall hangings, etc., within the interior space.

From the foregoing, it will be seen that this invention is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense. Additional objects, advantages, and novel features of the invention will be set forth in part in the description which follows, and in part will become apparent to those skilled in the art upon examination of the following or may be learned by practice of the invention.

What is claimed is:

1. A pair of brackets used to construct a corner joint joining a first studded wall to a second studded wall, the pair of brackets including:

a first bracket configured to attach to an upper end of the first studded wall and the second studded wall; and a second bracket configured to attach to a lower end of the first studded wall and the second studded wall opposite said first bracket, wherein each of the first bracket and the second bracket are configured such that, when the first studded wall is joined to the second studded wall using the first bracket and the second bracket forming the corner joint, an interior side of the corner joint includes two interior faces coming together at a right-angled corner, and an exterior side of the corner joint directly opposite the right-angled corner includes an arcuate exterior face, wherein each of the first bracket and the second bracket include a first track and a second track, the first track and the second track extending perpendicular to each other, corresponding to a direction of extension of the first studded wall and the second studded wall, respectively.

2. The pair of brackets of claim 1, wherein the first track of each of the first bracket and the second bracket is configured to attach to the first studded wall, and wherein the second track of each of the first bracket and the second bracket is configured to attach to the second studded wall.

3. The pair of brackets of claim 2, wherein each of the first bracket and the second bracket include an interior lip and an exterior lip, the interior lip extending along an interior side of both the first track and the second track and the exterior lip extending along an exterior side of both the first track and the second track, and wherein, when the first studded wall is joined to the second studded wall using the first bracket and the second bracket, the interior lip and the exterior lip of the first bracket extend downward towards the second bracket, and the interior lip and the exterior lip of the second bracket extend upward towards the first bracket.

4. The pair of brackets of claim 3, wherein the exterior lip is curved along a majority of a length of the exterior lip.

5. The pair of brackets of claim 4, wherein each of the first track and the second track include an open end having no lip.

6. The pair of brackets of claim 3, wherein each of the interior lip and the exterior lip of the first bracket is configured to attach to at least one of an upper end of a stud in each of the first studded wall and the second studded wall, or a top plate in each of the first studded wall and the second studded wall, and wherein each of the interior lip and the exterior lip of the second bracket is configured to attach to at least one of the lower end of the stud in each of the first studded wall and the second studded wall, or a sill plate in each of the first studded wall and the second studded wall.

7. The pair of brackets of claim 1 further comprising a corner support, wherein, when the first studded wall is joined to the second studded wall using the first bracket and the second bracket, the corner support is configured to extend along the right angle formed by the corner joint.

8. The pair of brackets of claim 1 further comprising a plurality of arcuately shaped, horizontally extending supports, wherein, when the first studded wall is joined to the second studded wall using the first bracket and the second bracket, the plurality of horizontally extending supports are configured to extend along the arcuate exterior face.

9. A building wall having a right-angled interior corner and an arcuate exterior corner, the building wall comprising:

a first studded wall extending in a first direction, the first studded wall including:

a first horizontally extending top plate; and a first horizontally extending sill plate;

a second studded wall extending in a second direction perpendicular to the first direction, the second studded wall including:

a second horizontally extending top plate; and a second horizontally extending sill plate; and a pair of corner brackets joining the first studded wall to the second studded wall and forming a corner joint, the pair of corner brackets including:

a first bracket configured to attach to an upper end of the first studded wall and the second studded wall; and a second bracket configured to attach to a lower end of the first studded wall and the second studded wall, wherein an interior side of the corner joint includes two interior faces coming together at the right-angled interior corner, and wherein an exterior side of the corner joint directly opposite the right-angled corner includes an arcuate exterior face.

10. The building wall of claim 9, wherein each of the first bracket and the second bracket include a first track and a second track, wherein the first track of each of the first bracket and the second bracket is attached to the first studded wall, and wherein the second track of each of the first bracket and the second bracket is attached to the second studded wall.

11. The building wall of claim 10, wherein each of the first bracket and the second bracket include an interior lip and an exterior lip, the interior lip extending along an interior side of both the first track and the second track and the exterior lip extending along an exterior side of both the first track and the second track, and wherein the interior lip and the exterior lip of the first bracket extend downward towards the second bracket, and the interior lip and the exterior lip of the second bracket extend upward towards the first bracket.

12. The building wall of claim 11, wherein the exterior lip is curved along a majority of a length of the exterior lip.

13. The building wall of claim 11, wherein each of the interior lip and the exterior lip of the first bracket are attached to at least one of an upper end of a stud in each of the first studded wall and the second studded wall, or the top plate in each of the first studded wall and the second studded wall, and wherein each of the interior lip and the exterior lip of the second bracket are attached to at least one of the lower end of the stud in each of the first studded wall and the second studded wall, or the sill plate in each of the first studded wall and the second studded wall.

14. The building wall of claim 9 further comprising a corner support extending along the right-angled interior corner.

15. The building wall of claim 14 further comprising a plurality of arcuately shaped, horizontally extending supports extending at the arcuate exterior face.

16. A method of constructing a building wall having a right-angled interior corner and an arcuate exterior corner, the method comprising:

constructing a first studded wall extending in a first direction;

constructing a second studded wall extending in a second direction perpendicular to the first direction; and joining the first studded wall to the second studded wall using a pair of corner brackets forming a corner joint, wherein an interior side of the corner joint includes two interior faces coming together at the right-angled interior corner, and wherein an exterior side of the corner joint directly opposite the right-angled interior corner includes an arcuate exterior face.

17. The method of claim 16 further comprising:

attaching a corner support to each of the pair of corner brackets, the corner support extending along the corner joint at the right-angled interior corner; and attaching a plurality of arcuately shaped, horizontally extending supports at the arcuate exterior face.

18. The method of claim 17 further comprising attaching sheathing to the plurality of horizontally extending supports.

19. The method of claim 16 further comprising attaching sheathing to the arcuate exterior face.

20. The method of claim 19, wherein the sheathing is drywall, and wherein attaching the sheathing to the arcuate exterior face includes bending the drywall about the arcuate exterior face.

* * * * *